US005317913A

United States Patent [19]

Feistkorn et al.

[11] Patent Number: 5,317,913

[45] Date of Patent: Jun. 7, 1994

[54] APPARATUS FOR DETERMINING THE SAG OF A RUNNING WEB OF MATERIAL TRANSVERSELY TO ITS LONGITUDINAL DIRECTION

[75] Inventors: Werner Feistkorn, Saerbeck; Klaus P. Vob, Lengerich, both of Fed. Rep. of Germany

[73] Assignee: Windmoller & Holscher, Lengerich, Fed. Rep. of Germany

[21] Appl. No.: 773,318

[22] Filed: Oct. 10, 1991

[30] Foreign Application Priority Data

Oct. 10, 1990 [DE] Fed. Rep. of Germany ..... 4032158

[51] Int. Cl.[5] ..... G01N 03/08; G01L 05/04

[52] U.S. Cl. ..... 73/159; 73/826

[58] Field of Search ..... 73/159, 862.49, 826; 226/34

[56] References Cited

U.S. PATENT DOCUMENTS 2,674,127 4/1954 Garrett et al. ..... 73/159

2,923,150 2/1960 Imboden et al. ..... 73/159 X 3,385,106 5/1968 Fargo et al. ..... 73/159

4,970,895 11/1990 Haughton et al. ..... 73/159

5,123,284 6/1992 Edinburg et al. ..... 73/159 X

FOREIGN PATENT DOCUMENTS 1531135 11/1978 United Kingdom ..... 73/159

*Primary Examiner*—Daniel M. Yasich

*Attorney, Agent, or Firm*—Keck, Mahin & Cate

[57] ABSTRACT

This invention refers to an apparatus for determining the sag of a running web of material transversely to its longitudinal direction. For this purpose according to the invention a carrier of a web sensing roller is guided in a housing to be movable against spring force transversely to its rotational axis and apparatus is provided for measuring the displacement distance of the roller. The roller is replicated in triplicate across the width of the web. In other embodiments web sag is measured by roller rotation and by web force respectively on the three rollers.

14 Claims, 6 Drawing Sheets

APPARATUS FOR DETERMINING THE SAG OF A RUNNING WEB OF MATERIAL TRANSVERSELY TO ITS LONGITUDINAL DIRECTION

BACKGROUND OF THE INVENTION

1. Field of the Invention

This invention relates to an apparatus for determining the sag of a running web of material transversely to its longitudinal direction.

2. Description of Prior Art

For determining the characteristics of a running web of material, for example for the purpose of subjecting the web to a further treatment in accordance with the determined characteristics, it may be necessary to measure the sag of the web transversely to its running direction Such a measurement of the sag is for example, required in the method for the reduction of the sag of a flattened tubular film web of thermoplastic material, produced by blow molding, transversely to its longitudinal direction, as described in U.S. patent application Ser. No. 07/709,319 now pending. The methods as described in said patent application for the reduction of the sag are made use of according to the size of the measured sag.

SUMMARY OF THE INVENTION

It is the object of the invention to provide an apparatus for determining the sag of a running web of material transversely to its longitudinal direction.

According to a first aspect of the invention a bearing or carrier of a sensing roller is guided in a housing to be movable against spring force transversely to its rotational axis, and means measuring the displacement distance of the bearing is provided If the web, the sag of which is to be measured, is led over e.g. two guide rollers or idler rollers mounted in the machine frame, the sensing roller can be adjusted to the web in the section to be measured so that the deviation of the web from its desired position can be measured, wherein then the desired position is assumed to be known for instance from the location of the guide rollers. The sensing roller presses the section to be measured, which is constituted by a width section, out of the plane defined by the web edges, and from the degree of the moving out of the selected width section from the reference plane there can be determined the sag of the web.

Advantageously, the bearing is provided with a forked shape, a bridge part of the forked bearing being provided with two rods on the side opposite legs of the forked bearings, said rods being movably guided with low friction in the bores of the housing For the moveable guiding of the rods with low friction there can be provided linear ball bearings (ball bearing bushings).

According to a further development of the invention it is provided that the rods extend through coiled springs which on the one hand are supported on the bearing fork and on the other hand on annular stoppers fixed to the housing, wherein the rods are secured by stoppers against a complete displacement out of the bores. By means of a rod or the like, the bearing fork can be connected to a means measuring its displacements. Said means can for instance be an inductive distance sensor.

According to a second aspect of the invention a roller can be provided which can be frictionally adjusted to the web, the shaft carrying said roller and being rotatably mounted in the support part being connected to a revolution counter. According to this embodiment of the invention there is measured the running length of the respective width section of the web, which is larger due to the sag, instead of directly measuring the sag, said running length being representative of the existing sag. Thus, the revolution counter is a length metering means measuring the difference in length compared to the unstretched web sections which are given by the edge sections of the web.

According to a particularly advantageous development of the invention it is provided that respectively at least three rollers are arranged axially spaced apart and next to each other along the width of the web. According to this embodiment, on the basis of the measured different plunging depths of the sensing rollers or of the different revolutions of the rollers, the sag of the web can be determined without desired values having to be given.

Advantageously, the rollers are pivotally mounted on arms which can be pivoted around axes being parallel to the rotational axes.

The arms can be mounted on levers, which are mounted on a shaft fixed in the apparatus, in such a manner that no rotation of the levers is permitted. Furthermore, the arms can be held by springs against stoppers of the levers.

For adjusting the rollers to the web in an easy manner, in a further development of the invention the shaft is provided with a pivoting means for adjusting and removing the rollers.

For facilitating the setting of the apparatus to different web widths, in the arrangement of three rollers or sensing rollers there is provided that the outer arms are axially displaceably guided on the shaft and settable by a spindle drive or the like as regards their distance to the middle arm.

According to a third aspect of the invention it is provided that on an axis fixed in the machine frame there are mounted at least three rollers or rolls of the same diameter which are mounted on force measuring bearings and are adjustable to the web. Corresponding to the existing sag, differently high pressure is applied to the force measuring bearings of the at least three rollers so that from the measured different adjusting forces the web sag can be determined.

Embodiments of the invention will now be described in the following with reference to the drawings.

DETAILED DESCRIPTION OF PREFERRED EMBODIMENTS

Figure 2:
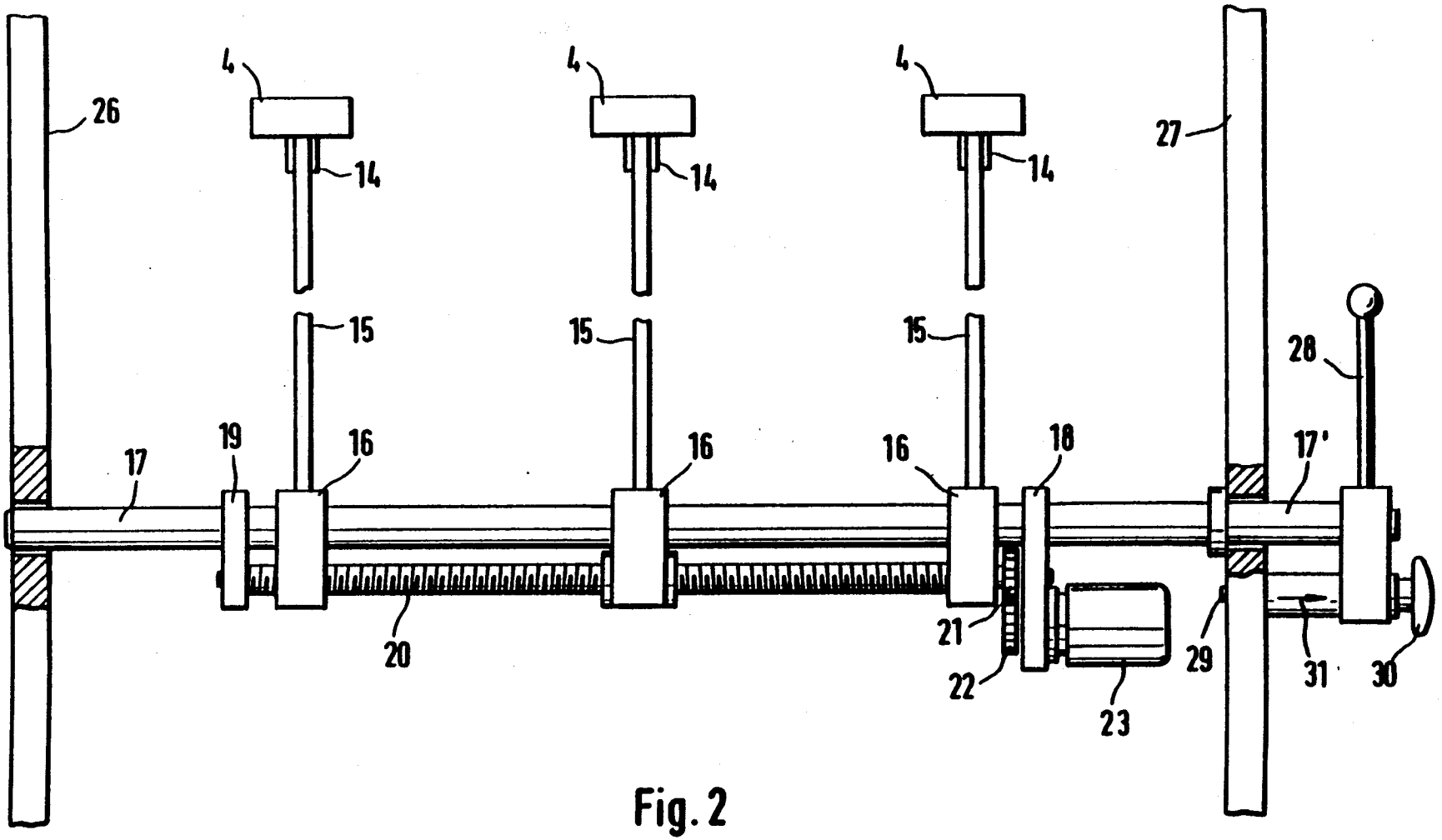
FIG. 2 is a rear view of the embodiment according to FIG. 1.

In FIG. 2 there are shown three sensing roller assemblies each comprising a sensing roller 1 which IS freely rotatably mounted in a U-shaped bearing or carrier which may be shaped as a stirrup 2 as shown in FIGS.

1 and 3. With each of said U-shaped stirrups 2 there are fixedly connected two rods 3 which are movably mounted in a housing 4. Retainer rings 6 are embedded in bores 5 of the housing 4, springs 7 being supported at one end thereof against said retainer rings 6. The other ends of the springs 7 contact the U-shaped stirrup 2 of each sensing roller 1. The springs 7 are pressure springs and have the effect that the end plates 8 of the rods closely contact the housing 4, when the sensing rollers are not moved into the housing 4 by a web 11 against the force of the springs 7. The inner bores of the retainer rings 6 are larger than the respective outer diameter of the rod 3. Rods 3 may be movably guided in bores 5 or housing 4 using low friction linear ball bearings 6' (ball bearings bushings).

Figure 3:
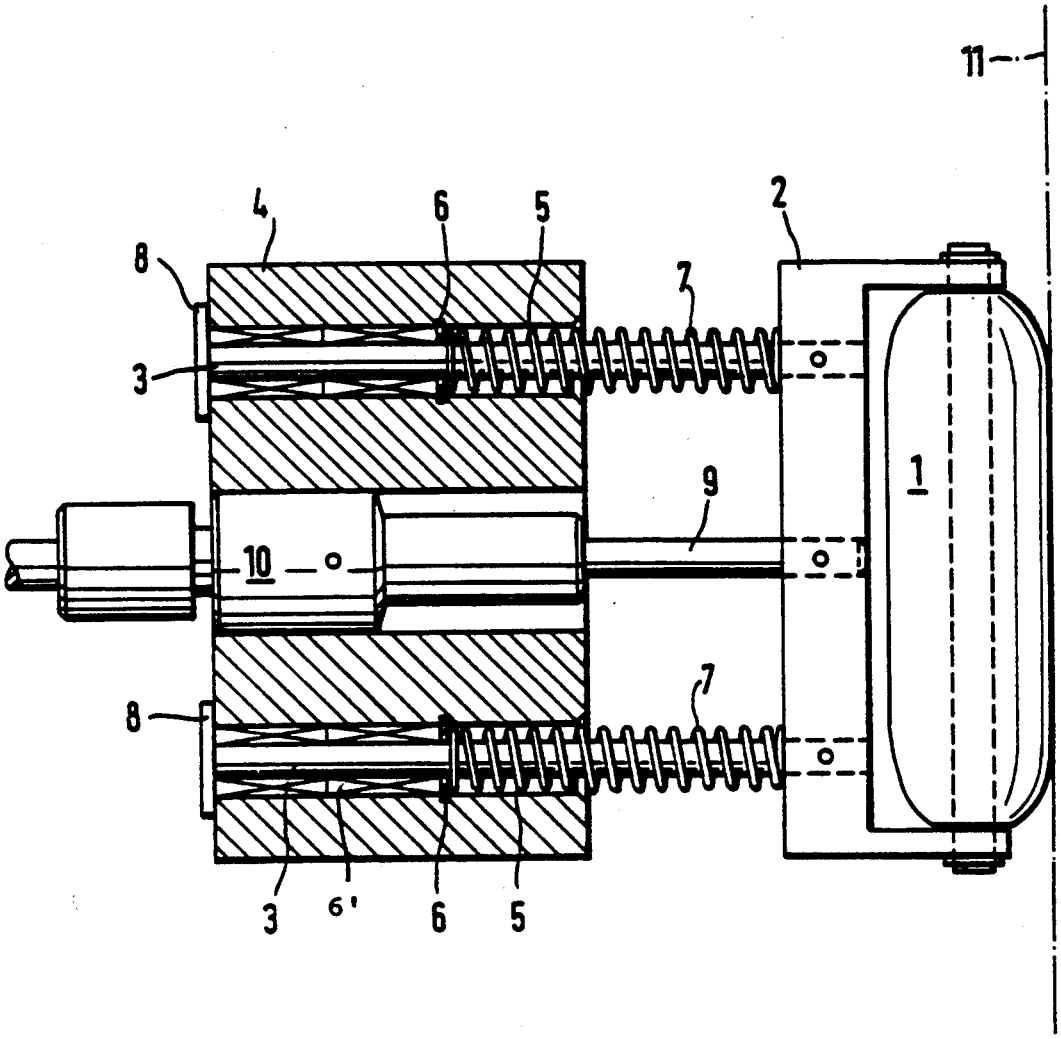
FIG. 3 is an enlarged plan, view of that part of FIG. 1 encircled by dot-dash lines.

In FIG. 3 there can also be seen that to each stirrup 2 a further rod 9 is connected which forms part of a length metering device 10 which can for example be an inductive distance sensor. Correspondingly, said length metering device 10 determines the distance by which the roller 1 is displaced by the film web 11 towards the housing 4.

Figure 1:
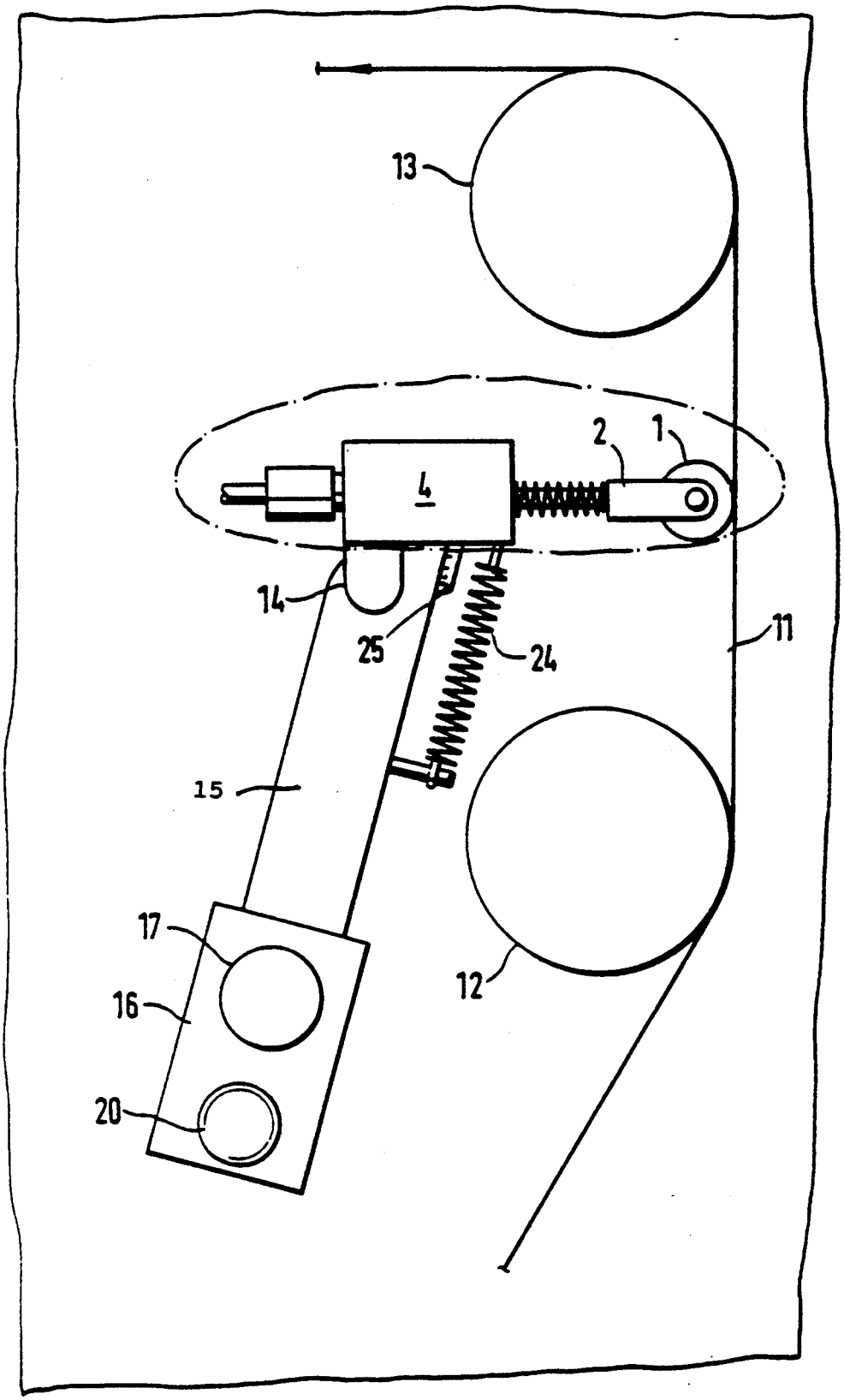
FIG. 1 is a side view of a first embodiment of sensing rollers for measuring the sag of a web.

Since in the embodiment according to FIGS. 1 through 3 a total number of three sensing rollers 1 is provided, the sag of the film web 11 can be determined on the basis of the values determined by the employed three length metering devices FIG. 1 shows the film web 11 led over two guide rollers 12 and 13, and in the section between said two rollers, and inserted the sensing rollers 1. The individual housings 4 of the sensing rollers 1 are provided with brackets 14 through which the housings 4 are hinged with levers 15. The ends of the levers 15 opposite the housings 4 are fixedly connected with bearing blocks 16, the two outer bearing blocks 16 being movably mounted on a shaft 17. For this purpose, to the shaft 17 there are attached two holding elements 18 and 19 in which the two ends of a threaded spindle 20 are drivably mounted i.e. to the threaded spindle 20 there is fixed at one end thereof a toothed wheel 21 which engages with a toothed wheel 22 drivable by a motor 23. The motor 23 is flange-mounted to the holding element 18. In FIG. 1 it is shown that upon the end of each housing 4 facing the film web 11 a tension springs 24 is provided which presses the respective housing 4 against a stopper 25 connected with the respective lever 15. For permitting the moving of the entire unit out of its operative position, the axis 17, which is mounted in the housing walls 26 and 27, with one end 17 thereof projecting out of the housing wall 27 to the outside. On this projecting end 17' pivoting lever 28 is fixedly arranged which has a resilient twistlock 29. Said resilient twistlock 29 can be pulled out of a bore in the housing side wall 27 by means of the knob 30 against the force of a spring (not shown) in direction of the arrow 31, so that through the pivoting lever 28 the complete unit can be pivoted around the axis 17 in counterclockwise direction (FIG. 1), and subsequently thereto the resilient twistlock 29 locks in a corresponding second bore of the housing side wall.

Figure 4:
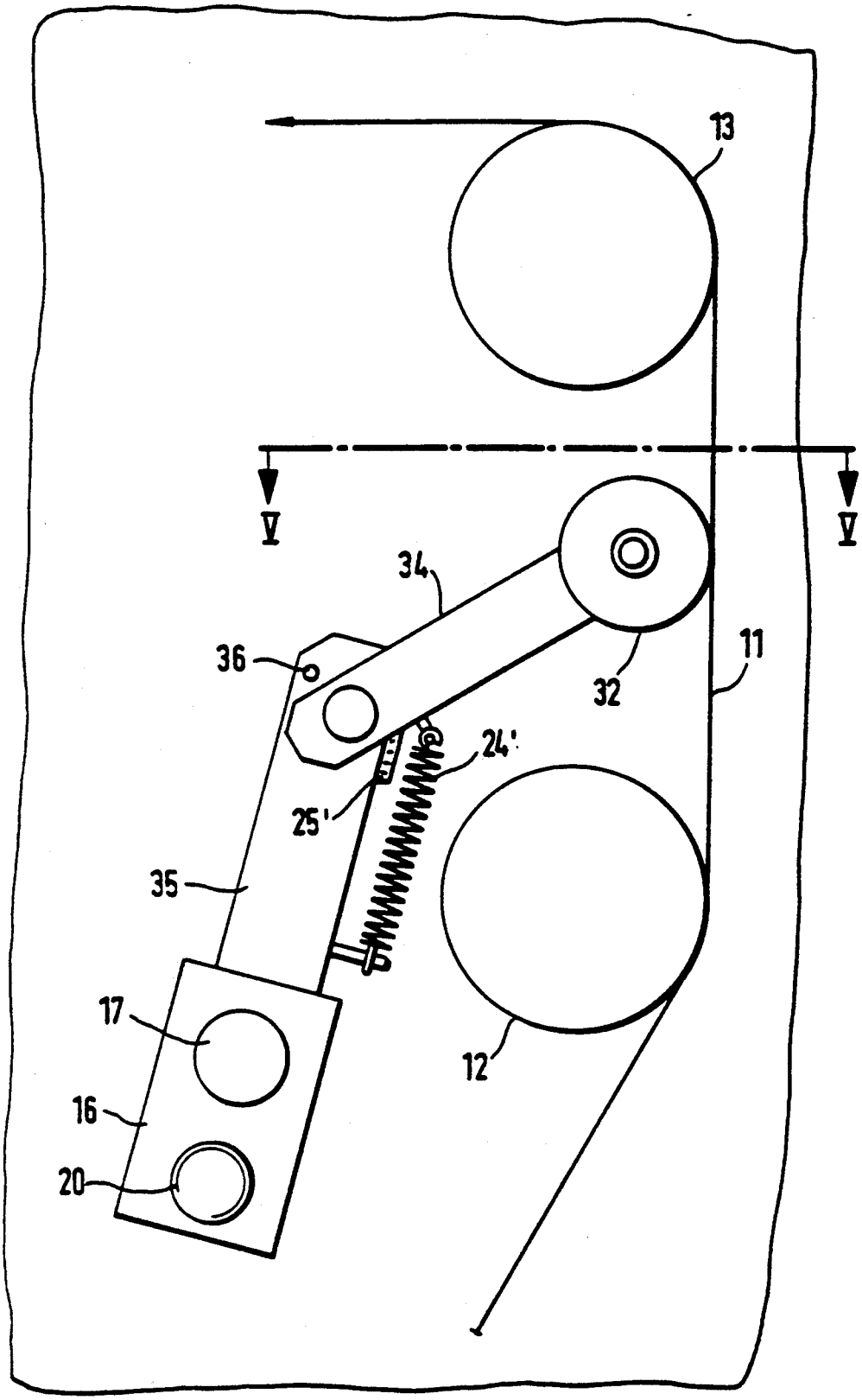
FIG. 4 is a side view of a second embodiment of sensing roller for measuring the sag of the web.
Figure 5:
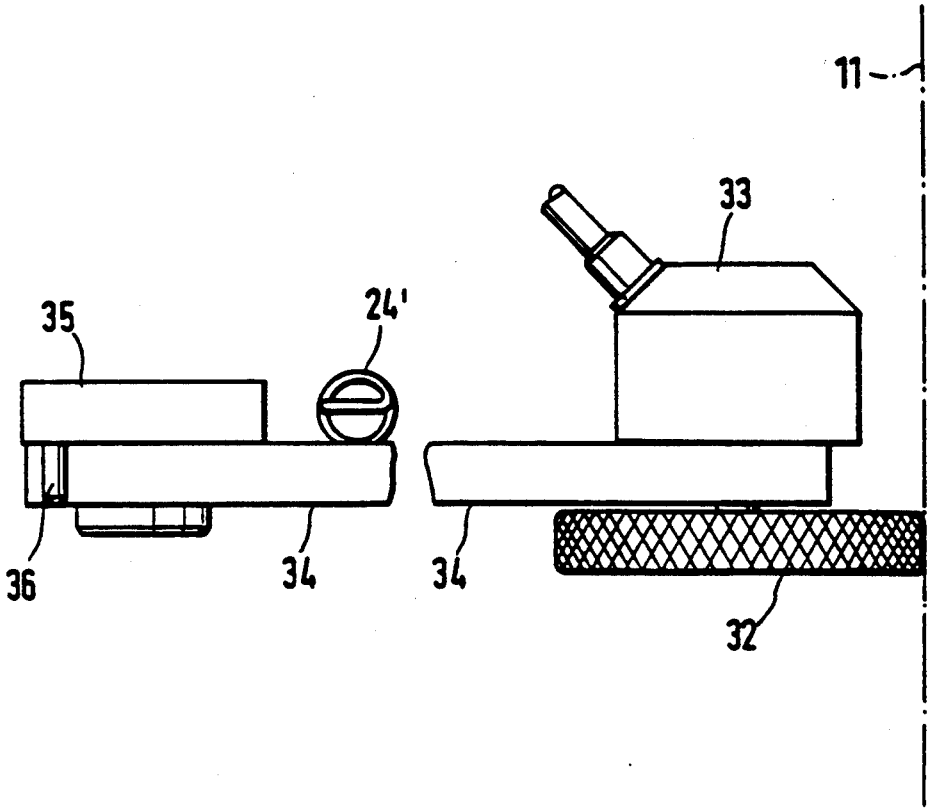
FIG. 5 is a view on line V—V in FIG. 4.

With respect to the adjustment of the two outer bearing blocks 16 it is to be pointed out that the threaded spindle 20 has opposed threads at its opposite ends so that on starting the motor 23 the two outer bearing blocks can be moved towards and away from each other, depending on the width of the web 11 to be measured As regards design, bearing and adjustment of the bearing blocks 16, the embodiment according to FIGS. 4 and 5 corresponds substantially to the embodiment according to FIGS. 1 through 3, however, in this embodiment three measuring rollers 32 arranged adjacent to each other are used which determine the lengths of the film web 11 running off the measuring rollers 32 per time unit by means of distance sensors 33. The differences of the three measuring signals consequently allow a direct conclusion as regards the amount of sag of the film web 11. As can be seen in FIGS. 4 and 5, the measuring rollers are mounted on 34 which are hinged with further levers 35, the latter fixed to the bearing blocks 16 by welding. Also in this . the levers 34 are drawn by springs 24' against the stoppers 25'. Further stop pins prevent the measuring rollers 32 from being pivoted too far, in the counterclockwise direction, referring to FIG. 4.

Figure 6:
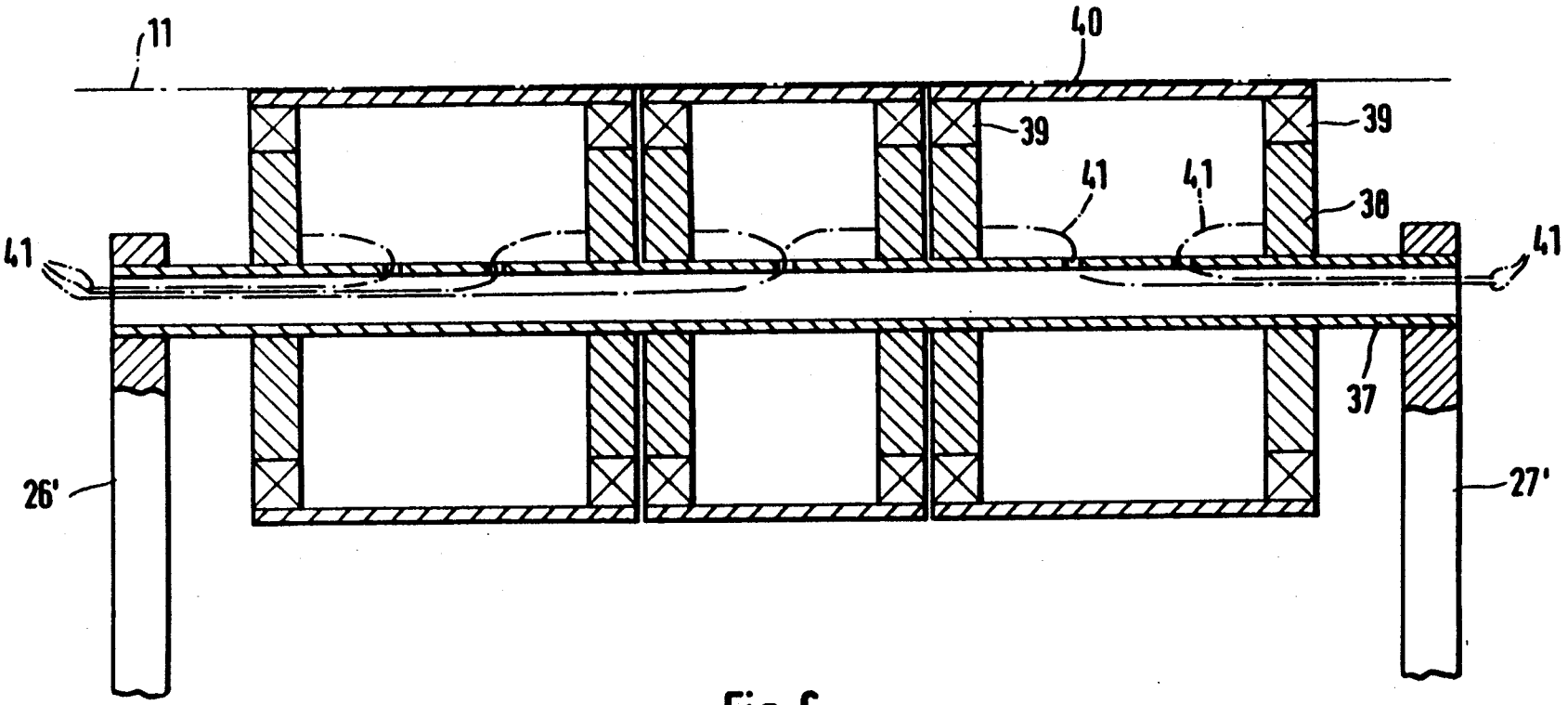
FIG. 6 is a sectional view of a third embodiment of roller for measuring the sag of the web.

In FIG. 6, showing a further example a hollow shaft 37 is fixedly connected to both side walls 26' and 27'. On said hollow shaft 37 there are arranged immovable disks 38 encircled by force measuring bearings 39. Two adjacent force measuring bearings 39 respectively carry one tube portion 40. In the shown example there are provided a total number of six force measuring bearings and consequently three tube portions 40. The film web 11 contacts said three tube portions 40 under pressure, wherein depending on the sag the pressure exerted by the web 11 on the tube portions 40 varies For the purpose of transmitting signals representative of the measured force, lines 41 are connected with the disks 38, said lines being led to the outside through the hollow shaft 37.

We claim:

1. Apparatus for determining sag of a travelling web transversely to a longitudinal direction of the web comprising a web-contacting sensing roller on a carrier, the carrier being mounted on a housing, spring means urging the carrier outwardly of the housing for providing contact of the roller with the web, and means connected to the carrier and to the housing for metering displacement of the roller and carrier with respect to the housing, said displacement being produced by sagging of the web.

2. Apparatus as claimed in claim 1 wherein the metering means comprises a rod connected between the carrier and a measuring head in said housing.

3. Apparatus as claimed in claim 2, wherein the measuring head comprises an inductive distance sensor.

4. Apparatus as claimed in claim 1 which is replicated in triplicate across the width of the web.

5. Apparatus according to claim 1 comprising at least three web-contacting rollers arranged axially spaced apart, adjacent to each other in a transverse direction of the web.

6. Apparatus for determining sag of a travelling web transversely to a longitudinal direction of the web comprising a web-contacting sensing roller on a carrier, the carrier being mounted on a housing, spring means urging the carrier outwardly of the housing for providing contact of the roller with the web, and means connected to the carrier and to the housing for metering displacement of the roller and carrier with respect to the housing, said displacement being produced by sagging of the web, wherein the carrier has a U-shape with arms between which the roller is mounted and rods projecting from the carrier guided in bores formed in the housing.

7. Apparatus as claimed in claim 6 including linear ball bearings in said bores for guiding said rods.

8. Apparatus as claimed in claim 6 wherein the spring means comprises a coil spring surrounding respective rods between the carrier and a retainer ring respective retainer rings being located in respective bores and wherein the rods have end plates preventing movement of the rods out of the bores.

9. Apparatus for determining sag of a travelling web transversely to a longitudinal direction of the web comprising a web-contacting sensing roller on a carrier, the carrier being mounted on a housing, spring means urging the carrier outwardly of the housing for providing contact of the roller with the web, and means connected to the carrier and to the housing for metering displacement of the roller and carrier with respect to the housing, said displacement being produced by sagging of the web, which is replicated in triplicate across the width on brackets pivoted about axes parallel to respective axes of the rollers.

10. Apparatus as claimed in claim 9 wherein the brackets are mounted on respective levers on a common shaft.

11. Apparatus as claimed in claim 10 including springs biasing the brackets into contact with respective stoppers on the levers.

12. Apparatus as claimed in claim 10 including lockable adjusting means for changing the angular position of the shaft.

13. Apparatus as claimed in claim 10 including means for adjusting relative spacing of the levers along the shaft.

14. Apparatus for determining sag of a travelling web transversely to a longitudinal direction of the web comprising a carrier and a roller means attached to the carrier, said carrier resiliently connected to a housing, said roller means contacting the web for sensing sagging of the web out of the plane defined by edges of the web, and measuring means connected to the carrier and to the housing for determining amount of sagging of the web out of said plane.

* * * * *